US005813092A

United States Patent [19]

Greenfield et al.

[11] Patent Number: 5,813,092

[45] **Date of Patent: *Sep. 29, 1998**

[54] HANGER HANDLE FOR A RECLOSEABLE BAG

[75] Inventors: Ronald J. Greenfield, Melville; Richard F. Schneider, Oakdale, both of N.Y.; Audrey M. Harper; Morton Schindel, both of Weston, Conn.

[73] Assignee: Monaco, LLC, Bethel, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 601,226

[22] Filed: Feb. 14, 1996

Related U.S. Application Data

[60] Provisional application No. 60/011,758 Feb. 12, 1996.

[51] Int. Cl.[6] ..... B65D 33/24

[52] U.S. Cl. ..... 16/110 R; 16/110 R; 383/15

[58] Field of Search ..... 16/110 R; 383/15, 383/6, 25, 23

[56] References Cited

U.S. PATENT DOCUMENTS

| | | | |
|---|---|---|---|
| 3,452,922 | 7/1969 | Hart . | |
| 3,495,763 | 2/1970 | Schmidt et al. . | |
| 3,528,471 | 9/1970 | Hartmann . | |
| 3,529,317 | 9/1970 | Schwarzkopf | 383/15 |
| 3,558,038 | 1/1971 | Gelles . | |
| 4,514,876 | 5/1985 | Houlberg | 383/15 |
| 4,641,360 | 2/1987 | Frank . | |
| 4,707,883 | 11/1987 | Irani et al. . | |
| 4,792,983 | 12/1988 | Allegre | 383/15 |
| 5,088,667 | 2/1992 | Olson . | |

FOREIGN PATENT DOCUMENTS

| | | | |
|---|---|---|---|
| 264411 | 10/1964 | Australia | 383/15 |
| 468167 | 3/1969 | Switzerland | 383/15 |

*Primary Examiner*—A. L. Pitts
*Assistant Examiner*—Mark Williams
*Attorney, Agent, or Firm*—St. Onge Steward, Johnston & Reens LLC

[57] ABSTRACT

A hanger handle for a recloseable bag is disclosed which comprises two complementary flexible side members shaped so that when fitted together they create a single, matched handle. Each complementary side member has a bottom edge strip to which an upwardly extending grip portion of a predominantly inverted, squat W-shape with a hook portion extending upward from one side of the grip portion to above the middle of the inverted, squat W-shape. Each complementary side member is also fitted with fasteners which enable the bag to be closed and the fasteners have a complementary tip-bevel shape with a lip for snapping the bag closed and securing it. Further, each complementary side member can optionally be equipped with recesses at offset points to provide tabs for finger and/or thumb access to open the handle.

2 Claims, 2 Drawing Sheets

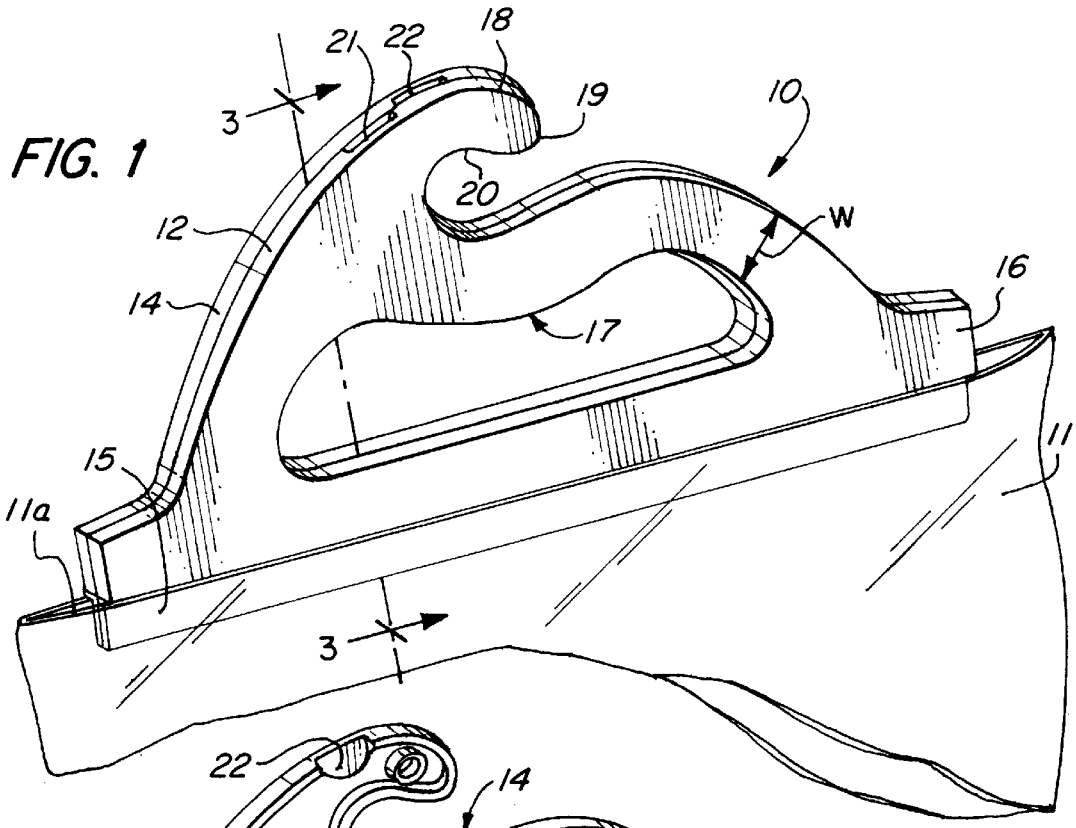
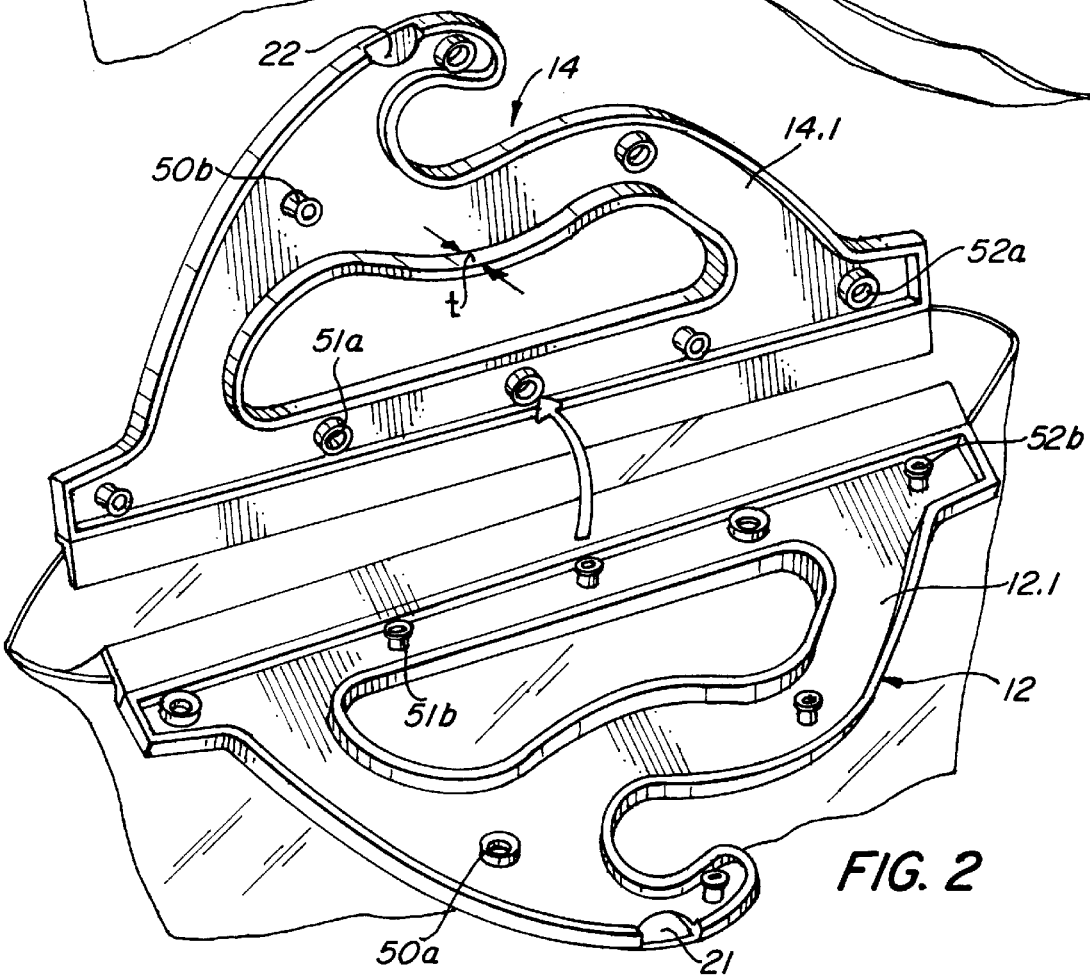
FIG. 2

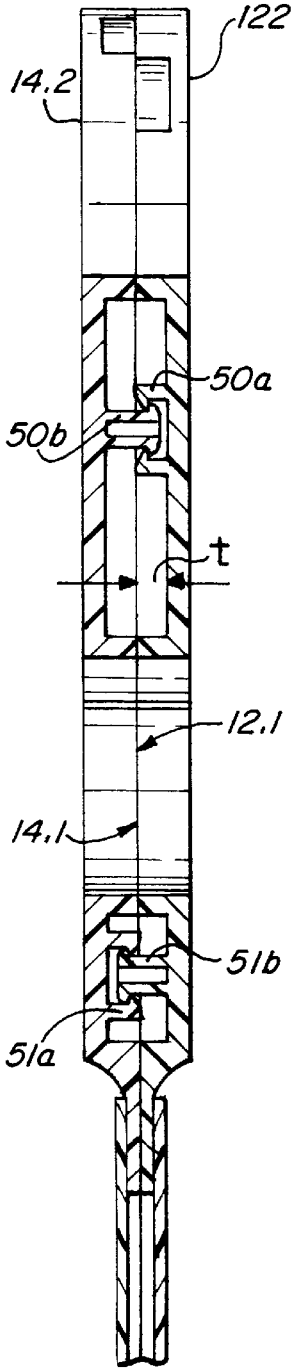
FIG. 3
FIG. 5
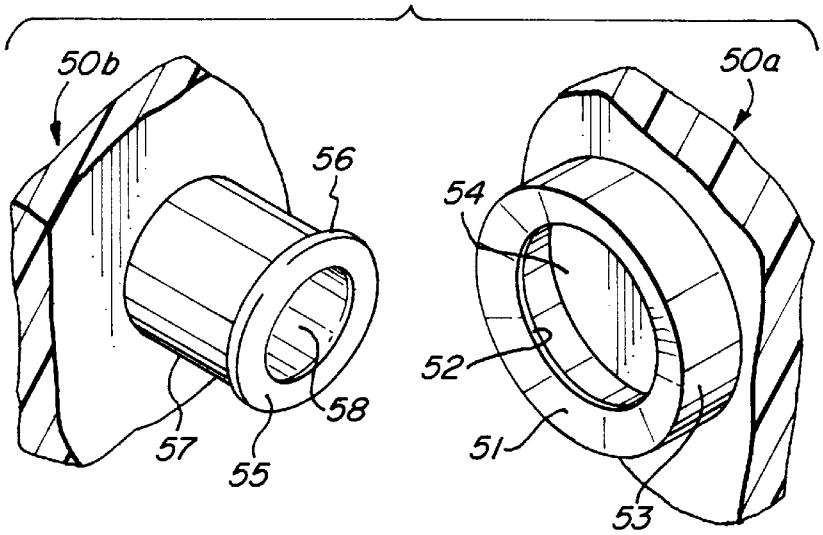
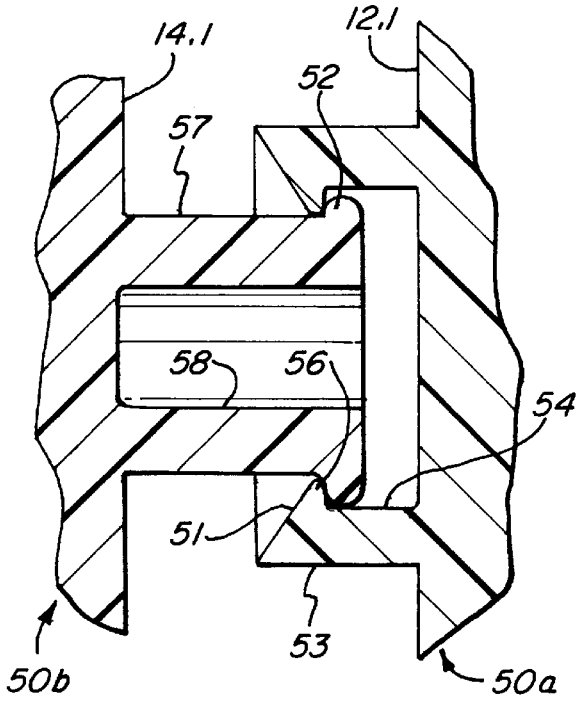
FIG. 4

HANGER HANDLE FOR A RECLOSEABLE BAG

RELATED APPLICATIONS

This application claims the benefit of U.S. Provisional application Ser. No. 60/011,758, filed Feb. 2, 1996.

FIELD OF THE INVENTION

The invention relates to a handle for an open mouthed bag which also acts as a hanger. The handle can either be opened to enable access to the inside of the bag, or snapped shut for storage and handling of the bag.

BACKGROUND OF THE INVENTION

Handle bags which also act as hangers are known in the prior art.

In U.S. Pat. No. 3,452,922, Hart teaches a handle for a hanger bag that can also open to the contents of the bag or snap together for transporting the bag. Hart, however, uses a snap that is difficult to open and close. Additionally, the upper and hook portions of the handle are filled in and include no snaps, making the handle heavier than necessary and not as securely closed.

Both Schmidt et al., in U.S. Pat. No. 3,495,763, and Gelles, in U.S. Pat. No. 3,558,038, teach the use of a ball headed pin which fits into a circular opening as the snapping device. This snap design is also difficult to open and close, requiring substantial pulling force or pressure be applied to perform the respective task. Additionally, the handle taught by Schmidt et al. only has a temporary hook that is discarded after its first use. Even if the user decided to keep the hook attached, the perforation would eventually weaken, causing the hook to fall off. Further the hook would hinder easy carrying of the bag prior to the hooks removal.

The handle taught by Gelles is also additionally disadvantageous in that the carrying handle portion is located off center, causing discomfort when carrying. This off center handle also causes the bag to hang crooked, which is undesirable and could lead to the bag slipping off a bar on which the bag is hung.

Schwarzkopf teaches the use of a different type of snap for closing a handle attached to a bag in U.S. Pat. No. 3,529,317. This handle snaps by the insertion of an elongated square edge in a similarly shaped recess. This snap would also be difficult to open and close and would have the further disadvantage of slipping along the direction of the edge so that the handle either would not easily remain flush or would slip until the handle opened up.

What is desired, therefore, is a handle which can easily be opened and closed, is strong and lightweight, and has a shape that is comfortable for carrying even heavy wares, but that can also easily be hooked and unhooked from a bar. Further the hook section must be formed so that the hook portion is not easily broken off.

SUMMARY OF THE INVENTION

Accordingly, it is an object of the invention to provide a hanger handle that is easy to open and close.

Another object of the invention is to provide a hanger handle that is lightweight yet strong enough to support most contents of the bag.

A further object of the invention is to provide a hanger handle that is comfortably carried and easily hung.

Other objects of the invention will be obvious and may in part appear hereinafter.

These and other objects are achieved by provision of a handle consisting of two pieces, each attached to one side of an open mouthed bag. The handle components are predominantly hollowed out, containing only the fastening devices. The handle is shaped with a grip portion for comfortable carrying of even heavy contents and a hook portion for hanging the bag. The handle can be made from any lightweight material that is easily molded, however, a stiffer material provides more rigidity for easier carrying and better displaying of the contents in the attached bag.

Preferably, the fastening devices are constructed so that the tip ends of both the inserting and receiving portions are beveled for easier closing. The ends of the bevels are also fitted with a small ridge and corresponding recess to assist the handle in staying closed without hampering the opening of the handle.

In another aspect, the inventive handle may be furnished with recessed thumb tabs to aid in the opening of the handle. Preferably, the thumb tabs are located along the top curve of the handle for easy access.

The invention and its particular features and advantages will become more apparent from the following detailed description considered with reference to the accompanying drawings.

BRIEF DESCRIPTION OF THE DRAWINGS

FIG. 1 is a perspective view of a hanger handled recloseable bag in accordance with the present invention, whereby the hanger handle comprises both a handle and a hook portion.

FIG. 2 is a perspective view of the handle shown in FIG. 1, in a partially open position to show the how the two halves integrally fit.

FIG. 3 is a section view taken along line 7 in FIGS. 1 & 2, to illustrate the structure of the fasteners and how they fit together.

FIG. 4 is a portion of an enlarged cross-sectional view along line 7 in FIGS. 1 & 2, to illustrate the shape of the fasteners.

FIG. 5 is a perspective view of the enlarged cross-sectional view in FIG. 4, in a partially open position to show how the two sides of the fastener fits together.

DETAILED DESCRIPTION OF THE INVENTION

Referring to the drawings in detail, a hanger handle for a recloseable bag having an attached bag in accordance with the present invention, is shown and generally designated by the reference numeral (10). It should be noted that for the sake of clarity all the components and parts of hanger handle (10) with a recloseable bag (11) may not be shown and/or marked in all the drawings. Also, as used in this description, the terms "up," "down," "top," "bottom," "front," "back," etc. refer to a hanger handle (10) with a recloseable bag (11) when in the orientation illustrated in FIG. 1.

FIG. 1 depicts hanger handle (10) for recloseable bag (11) in accordance with the invention for carrying, storing, and/or displaying articles contained in the bag. Hanger handle (10) includes a pair of complementary mating half side members (12) and (14), side member (12) being at the front and side member (14) being at the rear. Two side members (12, 14) are shaped as mirror images of each other, that is they are complementary and when coupled together form hanger handle (10). Each side member (12, 14) has a lip thickness (illustrated as "t" in FIGS. 2 & 3) which accommodates a fastener (50, 51, 52, etc . . . ) as discussed below. Each side member (12, 14) includes a bottom edge strip (15) that is attached to each side of the open-mouth end (11*a*) of bag (11). The length of side members (12, 14) are less than the length of mouth (11*a*) of bag (11).

The length of bottom edge strip (15) is determined in part by the flexibility of the material used to form hanger handle (10) and the thickness of all of the members that form hanger handle (10). Hanger handle (10) can be formed of any material that has requisite flexibility, strength, and rigidity for the intended use. Hanger handle (10) can be made of a thermosetting material such as polyethylene or a thermoplastic material such as linear polyethylene, cellulosic or acrylic resins. If a more rigid material is chosen, or if wider members are selected ("width" is illustrated in FIG. 1 as "w"), bottom edge strip (15) will be shorter to allow access to the inside of bag (11). If more flexible material is chosen, or if thinner members are selected, bottom edge strip (15) will be longer and possibly extend to the edges of opening (11*a*) of bag (11); this added length will provide more rigidity when carrying articles in bag (11) while still providing sufficient flexibility to allow access to articles in bag (11).

As shown in FIG. 1, extending upward from bottom edge strip (15) is first a second bottom edge strip (16). Extending upward from second bottom edge strip (16) are two longitudinal elements which form the lower section of grip portion (17). Grip portion (17) forms a closed curvilinear loop which predominantly assumes the shape of a symmetrical, inverted, squat W, and is centered on second bottom edge strip (16). Grip portion (17) allows for insertion of fingers for carrying of hanger handle (10) with recloseable bag (11). Although the shape of grip portion (17) can be any selected for a desired application, the shape illustrated in FIG. 1 is preferred for comfortable carrying for most types of articles in bag (11).

Also as shown in FIG. 1, further extending from one leg of the inverted, squat W shaped grip portion (17) is a hook portion (18) ending in a rounded tip (19). The central portion (20) of the lower side of hook (18) is preferably located so that the bag hangs straight for a more desirable display. It is desirable that tip (19) be rounded and sufficiently short to avoid snapping off after repeated hooking and unhooking, but also long enough to ensure that hook portion (18) will not slip off unintentionally.

As illustrated in FIGS. 1 & 2, along the outer edge of the extending member which ends in hook portion (18) are located two recessed, tabs (21, 22) to enable ease of opening hanger handle (10). Tabs (21, 22) can be shaped in any manner sufficient to enable either thumbs or fingers to engage their edges to assist opening of hanger handle (10). One optional embodiment, as illustrated in FIGS. 1 & 2, is a segment of a full circle. The circle can be of any diameter, however diameters ranging from about 1.3 to about 2.0 cm will be useful for most applications, with a preferred diameter of approximately 1.5 cm.

Tabs (21, 22) are located one on each side member (12, 14) and are offset to allow both tabs to be engaged simultaneously. A skilled artisan would recognize the preferred location for any given application. FIGS. 1 & 2 illustrate one preferred location on the upper edge of the extending member that ends in hook portion (18), but any location can be used.

FIG. 2 best displays the inner faces (12.1, 14.1) of side members (12, 14) which face each other and snap together when hanger handle (10) is closed. Inner faces (12.1, 14.1) of side members (12, 14) are predominantly hollowed out to reduce weight while maintaining strength. Each fastener (50, 51, 52, etc . . . ) comprises one fastening element of each fastener (50, 51, 52, etc . . . ) located on one inner face (12.1 or 14.1) of side member (12 or 14), with the complementary fastening element located on the other inner face (12.1 or 14.1) of side member (12 or 14), directly opposite when in the closed position. So, for example, when one side member (e.g., 12) is furnished with a female fastening element (e.g., 50*a*) the opposite side member (e.g., 14) is furnished with the complementary male fastening element (e.g., 50*b*) such that each female fastening element (e.g., 50*a*) will engage its complementary male fastening element (e.g., 50*b*) when side members (12 & 14) are brought together as illustrated in FIG. 3.

Fastening elements (e.g., 50*a*, 50*b*) are constructed so that they protrude from the back sides (12.2, 14.2) of side members (12, 14) in the direction of inner faces (12.1, 14.1) of side members (12, 14) (as seen in FIGS. 3 & 4).

Although the shape of female and male fastening elements will be in reference to fastener (50), as illustrate in FIGS. 4 & 5, the following discussion is applicable to all fastener (50, 51, 52, etc . . . ). Female fastening element (50*a*) comprise a circular ridge protrusion of material which extends only the thickness (t) of side member (12), and is beveled (51) at the top end of the protrusion and forms a cavity therein. At the lower end of bevel (51) there is located a lip (52) for securing hanger handle (10) in a closed position when in contact with the corresponding male fastening element (50*b*). Although the diameter of female fastening element (50*a*) will be determined by the particular application desired, for most applications the diameter of the outer wall (53) of female fastening element (50*a*) is approximately 7.0 mm to about 9.0 mm, and preferably about 8.0 mm. The diameter of the inner wall (54) of female fastening element (50*a*) is likewise determined by a particular application but will normally range from about 5.0 mm to about 7.0 mm, and preferably about 6.0 mm. Lip portion (52) extends over inner wall (54) of female fastening element (50*a*) so its diameter is approximately one half (0.5) a millimeter smaller than the diameter of inner wall (54) of female fastening element (50*a*), or about 4.5 mm to about 6.5 mm for most applications, and preferably about 5.5 mm.

Male fastening element (50*b*) is an extension protruding from side member (12) and is sized and shaped to fit inside female fastening element (50*a*). The top portion of male fastening element (50*b*) is also beveled (55) in the opposite direction of bevel (51) of female fastening element (50*a*). Male fastening element (50*b*) extends beyond the thickness (t) of side member (14) sufficient to enable lip (56) of male fastening element (50*b*) to lock in place inside lip (52) of female fastening element (50*a*). Male fastening element (50*b*) is also circular in shape and hollowed out having a diameter of the outer wall (57) of male fastening element (50*b*) determined by the diameter of inner wall (54) female fastening element (50*a*). Usually the diameter of outer wall (57) of male fastening element (50*b*) is approximately one half (0.5) a millimeter, or less, smaller than the diameter of inner wall (54) of female fastening element (50*a*). For most applications the diameter of outer wall (57) of male fastening element (50*b*) will range from about 4.5 mm to about 6.5 mm, and preferably will be approximately 5.5 mm.

Male fastening element (50*b*) is hollowed out to allow ease in opening and closing hanger handle (10). The diameter of inner wall (58) of male fastening element (50*b*) can be any diameter sufficient to retain requisite rigidity and strength for successive opening and closing of hanger handle (10), yet allow enough deformation of the material, in conjunction with deformation of female fastening element (50*a*), to enable lip (56) of male fastening element (50*b*) to fit inside lip (52) of female fastening element (50*a*) to fasten and release. Normally the diameter of inner wall (58) of male fastening element (50*b*) will be approximately 1.5 mm smaller than the diameter of outer wall (57) of male fastening element (50*b*), or approximately 3.0 mm to about 5.0 mm for most applications, and preferably about 4.0 mm.

The number of fastener (50, 51, 52, etc . . . ) is determined by the rigidity of the material used to form hanger handle (10), length of bottom edge strip (15), and the desired weight of articles that will be carried in bag (11). If a very flexible handle material or a longer of bottom edge strip (15) is employed, or if it is desired to carry heavy articles in bag (11), more fasteners (50, 51, 52, etc . . . ) will be necessary to increase the strength and rigidity of hanger handle (10). For most applications 5 to 10 fasteners (50, 51, 52, etc . . . ) will be sufficient. FIG. 2 depicts a preferred embodiment illustrating 7 fasteners (50, 51, 52, 53, 54, 55, 56) arranged as illustrated. Note that all female fastening elements (50*a*, 51*a*, 52*a*, etc . . . ) do not need to be located on the same side member (12 or 14). For added effectiveness in remaining closed, some female fastening elements (50*a*, 51*a*, 52*a*, etc . . . ) and some male fastening elements (50*b*, 51*b*, 52*b*, etc . . . ) are located on each side member (12, 14).

In the use of hanger handle (10) for recloseable bag (11), bag (11) can be made of any flexible material with sufficient strength to hold the desired articles. For example bag (11) could be made of a polymer such as a thin thermoplastic material of possibly liner polyethylene, cellophane, cellulose acetate, or stretched polytetrafluoroethylene (GORETEX™), or a thin thermosetting material such as polyethylene. Bag (11) can also be made of a textile or paper. The choice of bag material will determine the means used to attach bag (11) to hanger handle (10). The skilled artisan will immediately recognize which means of attachment is desirable for a given application and bag material, but some options include heat sealing, gluing, or attaching snaps or velcro.

Further bag (11) can be formed into any desirable shape, including but not limited to, a flat bag sealed on all three closed edges, a flat bag sealed only on two side edges, with the bottom edge consisting of a fold, or a flat bag formed from a tube of material that is only sealed on the bottom edge. Bag (11) could also be shaped into a pleated, grocery type bag which allows more room for articles, or any other shaped bag for unique displays.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A hanger handle for a recloseable bag, comprising:

a first and a second complementary sized and shaped flexible side members, the side members being shaped so as to fit together to form a single, matched handle, and wherein each side member comprises a bottom edge strip to which the bag is attached and a grip portion upwardly extending from the base portion, the grip portion comprises a closed curvilinear loop which defines a grip space, wherein the closed curvilinear space predominantly assumes the shape of an inverted, squat W;

the grip portion further comprises an arm extending from a first end thereof, said arm being shaped so as to form a hook portion which extends over a midpoint of the grip portion; and each of the side members having a plurality of distributed complementary interfitting male and female fastening elements disposed thereon, said arms having peripheral edges laterally projecting from a surface of the arms with segments of the peripheral edges removed so as to form respectively offset recesses located in the grip portion and sized to enable one to conveniently insert tips of fingers from opposite hands to pry the arms from each other to separate the interfitted fastener elements and the side members to open the bag.

2. The hanger handle for a recloseable bag in claim 1, wherein said recesses are located along upper edges of the hook portions of the side members and are laterally sized to enable finger and/or thumb access to open the handle.

* * * * *